United States Patent [19]

Kemeny

[11] Patent Number: 4,717,278

[45] Date of Patent: Jan. 5, 1988

[54] CONTAINER TOOTHBRUSH

[76] Inventor: George Kemeny, 2750 W. 33rd St., Apt. 2344, Brooklyn, N.Y. 11224

[21] Appl. No.: 460,031

[22] Filed: Jan. 21, 1983

[51] Int. Cl.[4] ..... A46B 11/04

[52] U.S. Cl. ..... 401/286; 132/84 R

[58] Field of Search ..... 401/132, 133, 134, 183, 401/184, 286, 287, 269, 190; 132/84 R, 84 B, 84 D

[56] References Cited

U.S. PATENT DOCUMENTS

| | | | |
|---|---|---|---|
| 1,859,108 | 5/1932 | Nadoolman | 132/84 B |
| 2,807,818 | 10/1957 | Taylor | 401/269 |
| 2,987,743 | 6/1961 | Capps | 401/190 |
| 3,356,095 | 12/1967 | Tylle | 401/134 |
| 4,176,980 | 12/1979 | O'Neal et al. | 401/184 |

*Primary Examiner*—John J. Wilson

*Attorney, Agent, or Firm*—Bernard Malina

[57] ABSTRACT

A container toothbrush for holding liquid toothpaste is provided and consists of a replaceable container having a threaded end portion, a toothbrush having a plurality of projecting bristles, a threaded counter bore that is removably attaches the toothbrush to the threaded end portion of the replaceable container, and a device for dispensing the liquid toothpaste from the container onto the bristles of the toothbrush just prior to brushing teeth.

1 Claim, 3 Drawing Figures

CONTAINER TOOTHBRUSH

BACKGROUND OF THE INVENTION

The instant invention relates generally to toothbrushes and more specifically it relates to a container toothbrush that uses liquid toothpaste.

At present time brushing one teeth requires two hands so that toothpaste can be placed on the toothbrush, although there are many situations when using one hand only would be desirable. It is therefore that this situation is in need of an improvement.

Numerous toothbrushes have been provided in prior art that are adapted to contain a toothpaste. For example, U.S. Pat. Nos. 2,218,290, 2,562,937, and 2,634,025 all are illustrative of such prior art. While these units may be suitable for the particular purpose to which they address, they would not be as suitable for the purposes of the present invention, and do not have many of the operative features of the present invention, as hereupon described.

SUMMARY OF THE INVENTION

A principle object of the present nvention is to provide a container toothbrush that uses liquid toothpaste whereby the liquid toothpaste is readily accessible within the container.

Another object is to provide a container toothbrush that uses liquid toothpaste whereby the liquid tooth paste is kept sanitary within the container.

An additional object is to provide a container toothbrush that uses liquid toothpaste whereby the container is removable and replaceable.

A further object is to provide a container toothbrush that uses liquid tooth paste and is simple and easy to use.

A still further object is to provide a container toothbrush that uses liquid toothpaste and is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
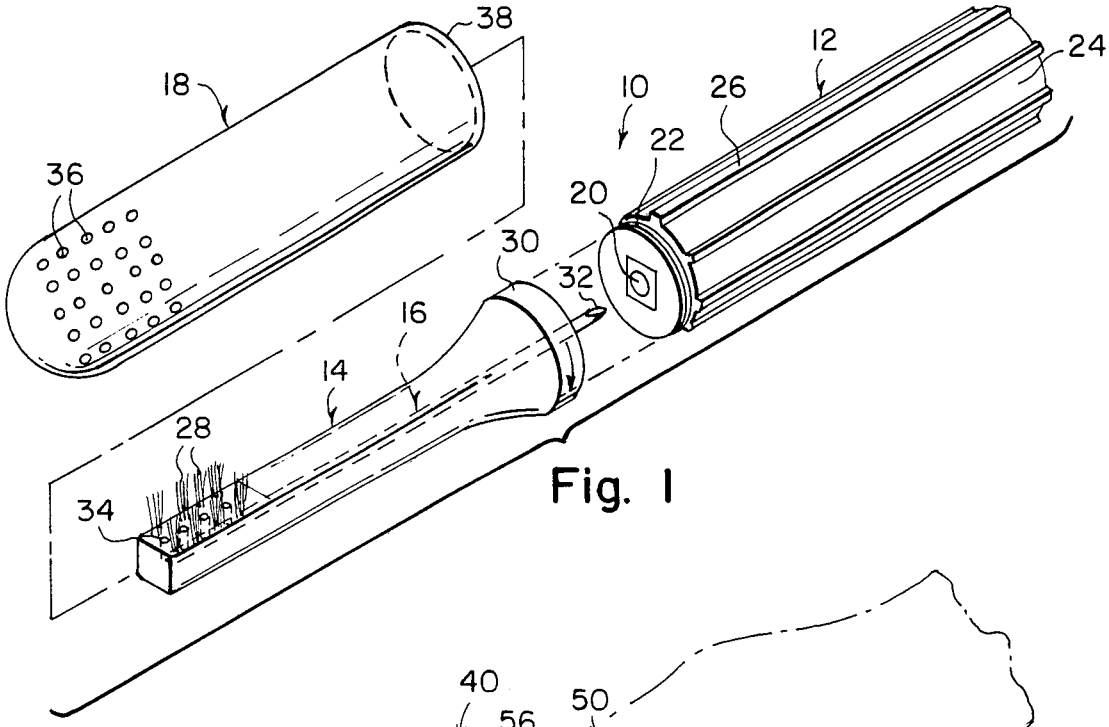
FIG. 1 is an exploded perspective view of the preferred embodiment of the invention.

Turning now descriptively to the drawings, in which similar reference characters denote similar elements throughout the several views FIG. 1 illustrates a container toothbrush 10 that uses liquid toothpaste. The container toothbrush 10 basically consists of a replaceable container 12, a toothbrush 14, a thin hollow tube 16 and a cover 18.

The replaceable container 12 for holding the liquid toothpaste has a foiled sealed aperture 20 at a threaded end portion 22. The container 12 is made of soft plastic 24 alternating with hard plastic strips 26 for stability when in use.

The toothbrush 14 has a plurality of projecting bristles 28 and a threaded counter bore 30 that is removably attached to the threaded end portion 22 of the replaceable container 12.

The thin hollow tube 16 runs through the toothbrush 14 with a pointed end 32 extending out of the counter bore 30 and other end to a plurality of small holes 34 beneath the bristles 28. When the toothbrush 14 and the container 12 are screwed together the pointed end 32 of the tube 16 will puncture the foil 20. The container 12 can be squeezed dispensing the liquid tooth paste from the container onto the bristles 28 of the toothbrush 14 via the thin hollow tube 16.

The cover 18 has a plurality of small holes 36 for air circulation. The cover 18 has an open end 38 that fits snugly on counter bore 30, covering over the toothbrush 14 protecting it from dust, pollution and insects.

Figure 2:
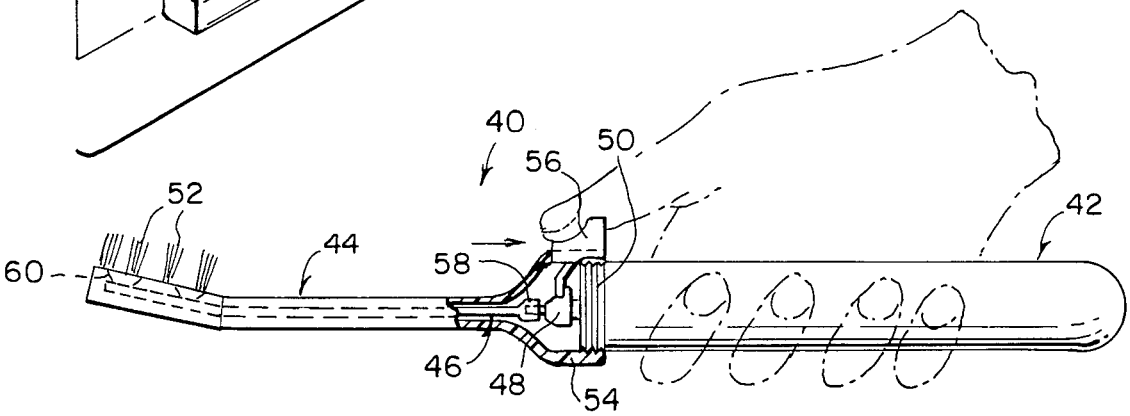
FIG. 2 is a side view with parts in section of a second embodiment of the invention.

FIG. 2 illustrates a second embodiment of a container toothbrush 40. The container toothbrush 40 basically consists of a replaceable pressurized aerosol container 42, a toothbrush 44 and a thin hollow tube 46.

The replaceable container 42 for holding the liquid toothpaste has a dispensing head 48 at a threaded end portion 50.

The toothbrush 44 has a plurality of projecting bristles 52, a threaded counter bore 54 that is removably attached to the threaded end portion 50 of the replaceable container 42 and a slide control 56 that engages and activates the dispensing valve head 48 of the replaceable container 42.

The thin hollow tube 46 runs through the toothbrush 44 with a connector end 58 extending into the counter bore 54 and other end to a plurality of small holes 60 beneath the bristles 52. When the toothbrush 44 and the container 42 are screwed together the connector end 58 of the tube 46 will engage the dispensing head 48 whereby the slide control 56 can engage and activate the dispensing head 48 of the container 42 dispensing the liquid toothpaste form the container 42 onto the bristles 52 of the toothbrush 44 via the thin hollow tube 46.

Figure 3:
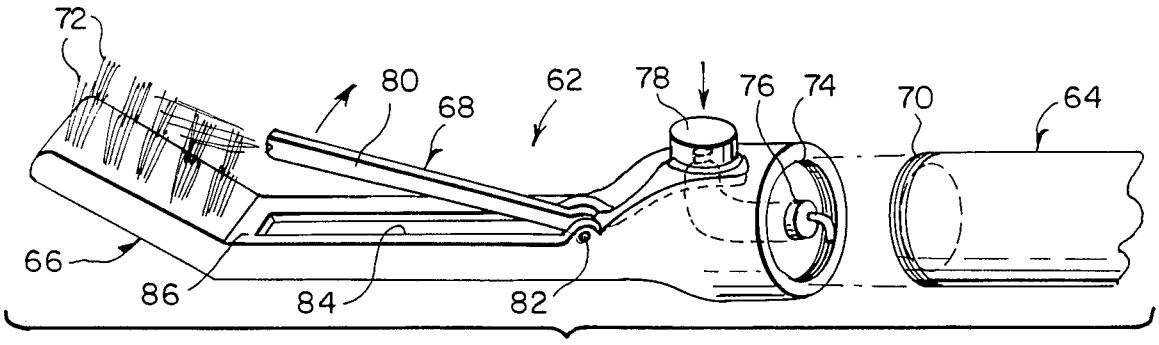
FIG. 3 is a perspective view if part os a third embodiment of the invention.

FIG. 3 illustrates a third embodiment of a container toothbrush 62. The container toothbrush 62 basically consists of a replaceable container 64, a toothbrush 66 and a dispensing member 68.

The replaceable container 64 for holding the liquid toothpaste has an open threaded end portion 70.

The toothbrush 66 has a plurality of projecting bristles 72, a threaded counter bore 74 that is removably attached to the threaded end portion 70 of the replaceable container 64 and a built-in pump mechanism 76 that will enter the open threaded end portion 70 of the replaceable container 64.

The dispensing member 68 has a push button 78 on one side and a hollow arm 80 on other side and is pivotally mounted at 82 within a recess 84 running along top 86 of the toothbrush 66. When the push button 78 is depressed it will activate the built-in pump 76 and simultaneously pivot the hollow arm 80 dispensing the liquid toothpaste from the container 64 onto the bristles 72 of the toothbrush 66 via the dispensing member 68. Naturally the liquid toothpaste is transported from pump 76, to dispensing member 68 by a short suitable piece of flexible tubing not show.

In operative use all three embodiments now permit liquid toothpaste to be dispensed to the bristles 28, 52, & 72 of the toothbrush when desired by the user in a clean sanitary efficient manner just before brushing his teeth.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container toothbrush that uses liquid toothpaste which comprises:

(a) replaceable container for holding the liquid toothpaste having an open threaded end portion;

(b) a toothbrush having a plurality of projecting bristles, a threaded counter bore that is removably attached to the threaded end portion of the replaceable container and a built-in pump mechanism that will enter the open threaded end portion of the replaceable container; and (c) a dispensing member having a push button on one side and a hollow arm on the other side and pivotally mounted with a recess running along top of the toothbrush so that when the push button is depressed it will activate the built-in pump and simultaneously pivot the hollow arm at the proper angle for dispensing the liquid toothpaste from the container onto the bristles of the toothbrush via the dispensing member.

* * * * *